United States Patent [19]

Schwarz, Jr.

[11] 4,239,017

[45] Dec. 16, 1980

[54] DEVELOPMENT SYSTEM

[75] Inventor: William M. Schwarz, Jr., Webster, N.Y.

[73] Assignee: Xerox Corporation, Stamford, Conn.

[21] Appl. No.: 57,867

[22] Filed: Jul. 16, 1979

[51] Int. Cl.[3] ..... G03G 15/00

[52] U.S. Cl. ..... 118/656; 29/120

[58] Field of Search ..... 118/656, 657, 658, 651; 355/3 DD; 430/122, 123; 101/1, DIG. 13; 29/120

[56] References Cited

U.S. PATENT DOCUMENTS

| | | | |
|---|---|---|---|
| 3,613,638 | 10/1971 | Solarek | 118/656 |
| 3,614,221 | 10/1971 | Solarek | 118/656 X |
| 3,664,857 | 5/1972 | Miller | 118/656 X |
| 3,879,123 | 4/1975 | Fisher | 355/3 DD X |
| 3,884,185 | 5/1975 | Liebman | 118/656 |

FOREIGN PATENT DOCUMENTS 53-67438 6/1978 Japan .

OTHER PUBLICATIONS

IBM Technical Disclosure Bulletin, vol. 8, No. 12, May 1966, Cross, R. G., p. 1730.

*Primary Examiner*—John P. McIntosh
*Attorney, Agent, or Firm*—H. M. Brownrout; C. A. Green; H. Fleischer

[57] ABSTRACT

An apparatus in which a latent image is developed with magnetic particles. The apparatus includes a magnetic member having a multiplicity of conductive fibers extending outwardly therefrom. Movement of the magnetic member advances the particles into contact with the latent image. As the particles are deposited on the latent image, the free end regions of at least a portion of the fibers contact the particles to aid in forming a substantially uniform particle image.

34 Claims, 4 Drawing Figures

DEVELOPMENT SYSTEM

This invention relates generally to an apparatus for developing a latent image with magnetic particles. An apparatus of this type is frequently employed in an electrophotographic printing machine.

Generally, an electrophotographic printing machine includes a photoconductive member which is charged to a substantially uniform potential to sensitize its surface. The charged portion of the photoconductive surface is exposed to a light image of an original document being reproduced. This records an electrostatic latent image on the photoconductive surface corresponding to the informational areas contained within the original document. After the electrostatic latent image is recorded on the photoconductive surface, the latent image is developed by bringing a developer mix into contact therewith. This forms a powder image on the photoconductive surface which is subsequently transferred to a copy sheet. Finally, the copy sheet is heated to permanently affix the powder image thereto in image configuration.

Frequently, the developer mix comprises toner particles adhering triboelectrically to carrier granules. This two component mixture is brought into contact with the latent image. The toner particles are attracted from the carrier granules to the latent image forming the powder image thereof.

With the advent of single component developer materials, carrier granules are no longer required. In general, the developer material particles have low resistivities, e.g. the resistivity ranges from about $10^4$ to about $10^9$ ohm-centimeters. During development, these particles are deposited on the latent image. Although development is optimized by employing particles having low resistivity or good conductivity, transfer is optimized by utilizing particles having high resistivity. Thus, the printing machine is faced with two contradictory requirements, i.e. the utilization of particles having low resistivity for optimum development and the requirement of high resistivity to achieve optimum transfer. It has been found that when more resistive particles are employed, they frequently produce images having portions of the solid areas deleted. A successful general approach to suppressing solid area deletions involves development with fields from five to one hundred times stronger than those typically employed. This may be achieved by locating a conductive roller having magnetic particles close to or even in virtual contact with the photoconductive surface. By way of example, reduction of the gap in the development zone from about twenty millimeters to about five millimeters has been effective in suppressing solid area deletions. However, such tolerances are not normally practical in a commercial product. Another approach is inductive magnetic brush development. In inductive magnetic brush development, a flexible conductive carrier brush is used to transport magnetic particles. This type of development system provides close spacing and generates a high field development condition. A variety of problems exist in this system, e.g. carrier bead loss, toner carrier mixing, and potential for triboelectric charge generation. The development system of the present invention transports the particles magnetically and provides a solid area deletion suppressing, high development field without imposing the critical spacing tolerances thereon.

Various approaches have been devised to improve development. The following disclosures appear to be relevant:

IBM Technical Disclosure Bulletin.
Volume 8, No. 12, page 1732
Author: Cross
Published: May, 1966
U.S. Pat. No. 3,614,221
Patentee: Solarck
Issued: Oct. 19, 1971
U.S. Pat. No. 3,664,857
Patentee: Miller
Issued: May 23, 1972
Japanese Patent Laid-Open No: 53-67438
Laid-Open Date: June 15, 1978
Japanese Patent Appln. No: 51-142260
Application Date: Nov. 29, 1976
Co-pending U.S. patent appln. Ser. No. 23,935
Filed: Mar. 21, 1979

The pertinent portions of the foregoing disclosures may be briefly summarized as follows:

Cross discloses a rotatable non-magnetic cylinder having helical iron spirals mounted thereon. The cylinder rotates in a container having magnets mounted externally thereof.

Solarck describes a woven pile brush having non-conductive and conductive pile fibers. The conductive pile fibers are shorter than the non-conductive fibers and can function as a development electrode while avoiding contact with the latent image.

Miller discloses a pair of metalized fur brushes having individual flexible filiments coated with a thin layer of an electrically conductive metal. One brush has low electrical conductivity, the other high electrical conductivity.

The Japanese patent application discloses a permenent magnet disposed inside of a rotatable cylindrical non-magnetic sleeve. A fiber brush whose volume electrical resistance ranges from about $10^6$ to about $10^{14}$ ohm-centimeters and whose height ranges from about 0.5 to about 10 millimeters is secured to the outer periphery of the non-magnetic sleeve.

The co-pending U.S. patent application discloses a magnetic brush developer roller employing a non-magnetic tubular member having a magnet disposed concentrically therein. A multiplicity of fibers extend in an outwardly direction from the non-magnetic tubular member. Relative movement between the non-magnetic tubular member and the magnetic member move the particles into contact with the latent image and move the free end regions of each of the fibers. As the particles are deposited on the latent image, the end regions of the fibers move forming a substantially uniform particle image.

In accordance with the features of the present invention, there is provided an apparatus for developing a latent image. The apparatus includes a magnetic member having a multiplicity of conductive fibers extending outwardly therefrom. Means are provided for moving the magnetic member to advance the particles attracted thereto into contact with the latent image. At least a portion of the fibers have the free end regions thereof contacting the particles deposited on the latent image to aid in forming a substantially uniform particle image.

Various aspects of the present invention will become apparent as the following description proceeds and upon reference to the drawings, in which.

While the present invention will hereinafter be described in connection with the various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
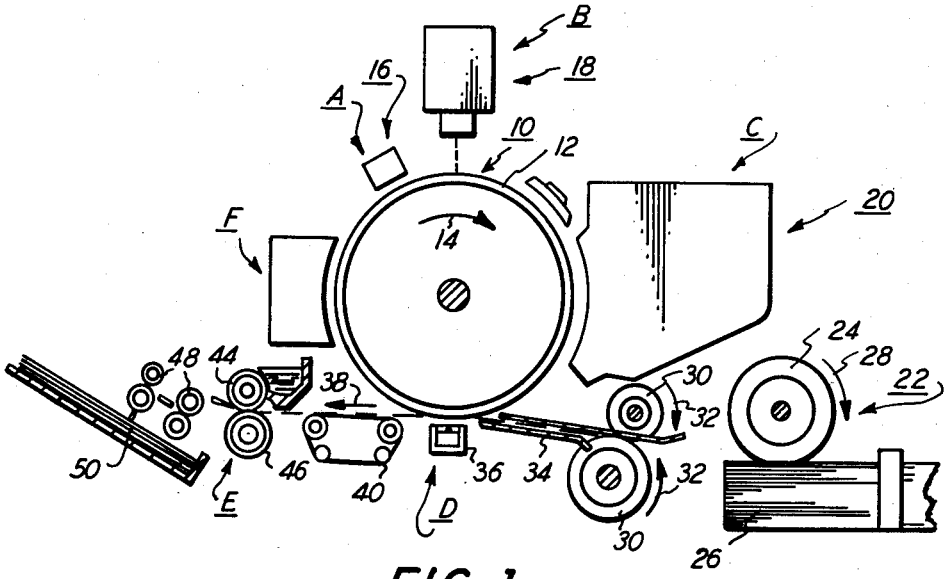
FIG. 1 is a schematic elevational view depicting the electrophotographic printing machine incorporating the elements of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that the development apparatus is equally well suited for use in a wide variety of electrostatographic printing machines, and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12. Preferably, photoconductive surface 12 comprises a transport layer containing a small molecule dispersed in an organic resinous material and a generation layer having trigonal selenium dispersed in a resinous material. Drum 10 moves in the direction of arrow 14 to advance successive portions of photoconductive surface 12 sequentially through the various processing stations disposed about the path of movement thereof.

Initially, a portion of the photoconductive surface passes through charging station A. At charging station A, a corona generating device, indicated generally by the reference numeral 16, charges photoconductive surface 12 to a relatively high substantially uniform potential.

Next, the charged portion of photoconductive surface 12 is advanced through exposure station B. Exposure station B includes an exposure system 18, wherein an original document is positioned face-down upon a transparent platen. The light rays reflected from the original document are transmitted through a lens to form a light image thereof. The lens focuses the light image onto the charged portion of photoconductive surface 12 to selectively dissipate the charge thereon. This records an electrostatic latent image on photoconductive surface 12 which corresponds to the informational areas contained within the original document. Thereafter, drum 10 advances the electrostatic latent image recorded on photoconductive surface 12 to development station C.

At development station C, a magnetic brush development system, indicated generally by the reference numeral 20, advances magnetic particles into contact with the electrostatic latent image. The electrostatic latent image attracts the particles forming a particle image on photoconductive surface 12 of drum 10. The detailed structure of the development system will be described hereinafter with reference to FIGS. 2 through 4, inclusive.

Drum 10 then advances the particle image to transfer station D. At transfer station D, a sheet of support material is advanced into contact with the particle image. The sheet of support material is advanced to transfer station D by a sheet feeding apparatus indicated generally by the reference numeral 22. Preferably, sheet feeding apparatus 22 includes a feed roll 24 contacting the uppermost sheet of a stack of sheets 26. Feed roll 24 rotates in the direction of arrow 28 so as to advance the uppermost sheet into the nip defined by forwarding rollers 30. Forwarding rollers 30 rotate in the direction of arrow 32 to advance the sheet into chute 34. Chute 34 directs the advancing sheet of support material into contact with the photoconductive surface of drum 10 so that the particle image developed thereon contacts the advancing sheet at transfer station D.

Transfer station D includes a corona generating device 36 which sprays ions onto the backside of the sheet. This attracts the particle image from photoconductive surface 12 to the sheet. After transfer, the sheet continues to move in the direction of arrow 38 onto a conveyor 40 which advances the sheet to fusing station E.

Fusing station E includes a fuser assembly, indicated generally by the reference numeral 42, which permanently affixes the transferred particle image to the sheet. Preferably, fuser assembly 42 includes a heated fuser roller 44 and a back-up roller 46. The sheet passes between fuser roller 44 and back-up roller 46 with the particle image contacting fuser roller 44. In this manner, the particle image is permanently affixed to the sheet. After fusing, the forwarding rollers 48 advance the sheet to catch tray 50 for subsequent removal from the printing machine by the operator.

Invariably, after the sheet of support material is separated from photoconductive surface 12 of drum 10, some residual particles remain adhering thereto. These residual particles are removed from photoconductive surface 12 at cleaning station F. Cleaning station F includes a rotatably mounted fiberous brush in contact with the photoconductive surface 12. Particles are cleaned from photoconductive surface 12 by the rotation of the brush in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
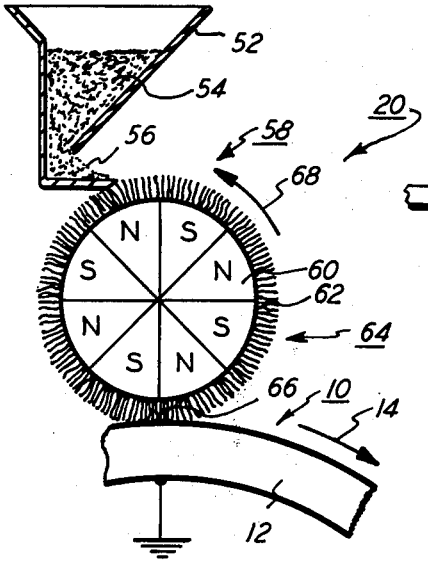
FIG. 2 is a schematic elevational view showing the development system employed in the FIG. 1 printing machine.

Referring now to the specific subject matter of the present invention, development apparatus 20 is depicted in FIG. 2. As shown in FIG. 2, development apparatus 20 includes a hopper 52 storing a supply of magnetic particles 54 therein. Preferably particles 54 have a high field resistivity breakdown, e.g. greater than $10^4$ volts/- centimeter, so as to obtain an optimum development threshold field and good solid area development. Particles 54 descend through aperture 56 in hopper 52 onto the surface of a developer roller, indicated generally by the reference numeral 58. Developer roller 58 includes an elongated, rotatably mounted cylindrical magnet 60. A tubular sleeve 62 is interfit over magnet 60. Preferably, tubular sleeve 62 is made from a fabric and has a multiplicity of ferromagnetic stainless steel tufts 64 extending in an outwardly direction therefrom. Fabric tube 62 is preferably cemented to magnetic member 60. A voltage source (not shown) electrically biases magnetic member 60 to a suitable magnitude and polarity to effect development of the latent image with the magnetic particles. Each tuft 64 on sleeve 62 includes a multiplicity of stainless steel fibers. The development gap is adjusted so that tufts 64 lightly contact photoconductive surface 12 of drum 10 in development zone 66. This establishes a high field development situation where the fibers function as closely spaced development electrodes. Thus, as particles 54 are being deposited on the latent image recorded on photoconductive surface 12, tufts 64 are in contact therewith. Tufts 64 extend about the entire circumferential surface of magnetic member 60. Preferably, each fiber of tuft 64 is made from a ferromagnetic stainless steel. Magnetic member 60 is made preferably from a barium ferrite having a magnetic field impressed thereon.

With continued reference to FIG. 2, magnetic member 60 rotates in the direction of arrow 68. Preferably, the angular velocity of magnetic member 50 is such that the tangential velocity thereof is four or five times greater than the tangential velocity of drum 10. Magnetic diodes are set up in each fiber of tuft 64 which causes movement of the free end region of each fiber. It is desirable to move the free end region of each fiber of tufts 64 both circumferentially and laterally. This may be achieved by employing fibers having differing magnetic properties. If each tuft fiber has differing magnetic properties. If each tuft fiber has differing magnetic properties, magnetic fields of varying strength are established between the fiber ends. Fiber motion is dependent upon the magnetic field gradient at any point on the fiber.

Figure 3:
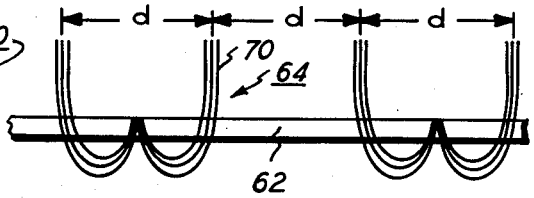
FIG. 3 is a fragmentary, exploded view illustrating one embodiment of the fiber weave used in the FIG. 2 development system.

Referring now to FIG. 3, there is shown one manner in which tufts 64 may be secured to fabric 62. Each tuft 64 includes a multiplicity of stainless steel fibers 70. Each group of fibers 70 and tufts 64 passes through fabric 62 in a W-shaped configuration. The distance, d, between each adjacent tuft 64 is substantially equal.

Figure 4:
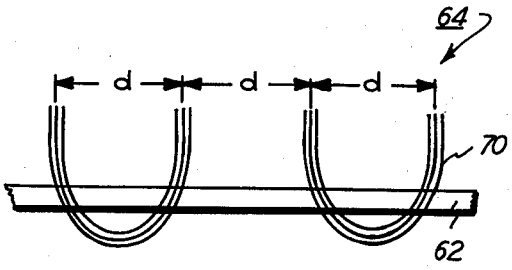
FIG. 4 is a fragmentary exploded view depicting another embodiment of the fiber weave used in the FIG. 2 development system.

An alternate method of weaving tufts 64 in fabric 62 is shown in FIG. 4. As depicted thereat, each fiber 70 of each tuft 64 passes through fabric 62 in a U-shaped configuration. Once again, the distance, d, between each adjacent tuft 64 is substantially equal.

By way of example, fabric 64 is preferably made from cotton having a conductive coating of black latext heavily loaded with carbon therein. Preferably, each tuft has from about 25 to about 150 fibers therein. Each fiber ranges from about 0.005 to about 0.015 millimeters in thickness and from about 60 to about 150 millimeters in height. It has been found that the density of the tufts is important and that too great a density prevents the independent movement of each fiber and results in particle blockages causing image streaking. Thus, it is preferred that there be from about 8 to about 16 tufts per square centimeter of fabric. The distance, d, between each adjacent tuft is preferably equal and ranges from about 0.20 centimeters to about 0.25 centimeters. It is desirable that the tufts be of sufficient height to form a fairly soft brush. However, it has been found that the height is but one parameter that defines the softness of the brush, another parameter is the manner of weave. Hence, a W-shaped weave, as shown in FIG. 3, has been found to be stiffer than a U-shaped weave, as depicted in FIG. 4.

Other suitable fibers may be made from a non-conductive material treated with polymer salts such as sodium polystyrene sulfonic to impart any desired degree of conductivity thereto.

In recapitulation, it is clear that the improved development system of the present invention utilizes a rotating magnetic cylinder having a multiplicity of fibers extending in an outwardly direction therefrom to transport magnetic particles into contact with a latent image recorded on a photoconductive surface. As the particles are deposited on the photoconductive surface in imaging configuration, the fibers contact the surface to insure that the particle image formed is uniform with substantially no particles being deleted therefrom.

It is, therefore, evident that there has been provided in accordance with the present invention an apparatus for developing an electrostatic latent image recorded on a photoconductive surface. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for developing a latent image with magnetic particles, including:

a magnetic member having a multiplicity of conductive fibers extending outwardly from the exterior surface thereof, said magnetic member attracting the magnetic particles to the conductive fibers; and means for moving said magnetic member to advance the particles into contact with the latent image with the free end region of at least a portion of the conductive fibers contacting the particles being deposited on the latent image to form a substantially uniform particle image.

2. An apparatus as recited in claim 1, wherein said fibers are magnetic.

3. An apparatus as recited in claim 2, wherein said magnetic member is a substantially cylindrical member.

4. An apparatus as recited in claims 2 or 3, wherein said fibers are grouped together to form a multiplicity of spaced tufts with each of said tufts having a multiplicity of said fibers.

5. An apparatus as recited in claim 4, wherein the spacing between adjacent tufts is substantially equal.

6. An apparatus as recited in claim 5, further including a fabric secured to said cylindrical member and having said tufts woven therethrough.

7. An apparatus as recited in claim 6, wherein said fabric includes a conductive coating.

8. An apparatus as recited in claim 7, wherein said tufts are woven through said fabric in a W-shaped configuration.

9. An apparatus as recited in claim 7, wherein said tufts are woven through said fabric in a U-shaped configuration.

10. An apparatus as recited in claim 7, wherein each of said tufts includes from about 25 to about 150 of said fibers.

11. An apparatus as recited in claim 7, wherein said fabric includes from about 8 to about 16 tufts per square centimeter.

12. An apparatus as recited in claim 7, wherein each of said fibers range in thickness from about 0.005 to about 0.015 millimeters.

13. An apparatus recited in claim 4, wherein said tufts are disposed about the entire exterior surface of said magnetic member.

14. An apparatus as recited in claim 4, wherein each of said fibers have substantially similar magnetic properties.

15. An apparatus as recited in claim 4, wherein each of said fibers have substantially dis-similar magnetic properties.

16. An apparatus as recited in claim 4, wherein said fibers are made preferably from stainless steel.

17. An apparatus as recited in claim 1, wherein said conductive fibers are made from a substantially non-conductive material having a substantially conductive coating thereon.

18. An electrophotographic printing machine of the type in which an electrostatic latent image recorded on a photoconductive surface is developed with magnetic particles, wherein the improvement includes:

a magnetic member having a multiplicity of conductive fibers extending outwardly from the exterior surface thereof, said magnetic member attracting the magnetic particles to the conductive fibers; and means for moving said magnetic member to advance the particles into contact with the electrostatic latent image recorded on the photoconductive surface with at least a portion of the free end regions of the conductive fibers contacting the particles being deposited on the electrostatic latent image to form a substantially uniform particle image.

19. A printing machine as recited in claim 18, wherein said fibers are magnetic.

20. A printing machine as recited in claim 19, wherein said magnetic member is a substantially cylindrical member.

21. A printing machine as recited in claim 19 or 20, wherein said fibers are grouped together to from a multiplicity of spaced tufts with each of said tufts having a multiplicity of said fibers.

22. A printing machine as recited in claim 21, wherein the spacing between adjacent tufts is substantially equal.

23. A printing machine as recited in claim 22, further including a fabric secured to said cylindrical member and having said tufts woven therethrough.

24. A printing machine as recited in claim 23, wherein said fabric includes a conductive coating.

25. A printing machine as recited in claim 24, wherein said tufts are woven through said fabric in a W-shaped configuration.

26. A printing machine as recited in claim 24, wherein said tufts are woven through said fabric in a U-shaped configuration.

27. A printing machine as recited in claim 24, wherein each of said tufts include from about 25 to about 150 of said fibers.

28. A printing machine as recited in claim 24, wherein said fabric includes from about 8 to about 16 tufts per square centimeter.

29. A printing machine as recited in claim 24, wherein each of said tufts range in thickness from about 0.005 to about 0.015 millimeters.

30. A printing machine as recited in claim 21, wherein said tufts are disposed about the entire exterior surface of said magnetic member.

31. A printing machine as recited in claim 21, wherein each of said fibers has substantially similar magnetic properties.

32. A printing machine as recited in claim 21, wherein each of said fibers has substantially dissimilar magnetic properties.

33. A printing machine as recited in claim 21, wherein said fibers are made preferably from stainless steel.

34. A printing machine as recited in claim 18, wherein said conductive fibers are made from a substantially non-conductive material having a substantially conductive coating thereon.

* * * * *